US005443347A

United States Patent [19]

Weinlader

[11] Patent Number: 5,443,347

[45] Date of Patent: Aug. 22, 1995

[54] BAG OPENER

[76] Inventor: J. Keith Weinlader, 337 Ludwell Dr., Lancaster, Pa. 17601

[21] Appl. No.: 220,871

[22] Filed: Mar. 31, 1994

[51] Int. Cl.[6] ..... B65B 69/00

[52] U.S. Cl. ..... 414/412; 53/381.2; 53/492; 414/406

[58] Field of Search ..... 414/412, 406, 786; 83/946; 53/381.2, 492

[56] References Cited

U.S. PATENT DOCUMENTS

| | | | |
|---|---|---|---|
| 3,853,235 | 12/1974 | Lambert et al. | 414/412 |
| 3,884,375 | 5/1975 | Schott, Jr. et al. | 414/412 |
| 4,344,268 | 8/1982 | Wakamatsu et al. | 53/381.2 |
| 4,798,508 | 1/1989 | Lewis | 414/412 |
| 4,929,141 | 5/1990 | Keesey et al. | 414/412 |
| 5,002,451 | 3/1991 | Hale et al. | 414/412 |
| 5,074,739 | 12/1991 | Takahashi et al. | 414/412 |
| 5,253,971 | 10/1993 | Weinlader | 414/412 |

FOREIGN PATENT DOCUMENTS

| | | | |
|---|---|---|---|
| 1227583 | 4/1971 | United Kingdom | 414/412 |

*Primary Examiner*—David A. Bucci
*Attorney, Agent, or Firm*—Hartman Underhill & Brubaker

[57] ABSTRACT

A bag opener for tearing a hole in a bag of plastic or other perforable material where a pair of fingers next to each other are moved together in one direction to puncture the bag and then in transverse directions respectively away from each other to provide a tearing action on the bag.

12 Claims, 6 Drawing Sheets

BAG OPENER

FIELD OF INVENTION

This invention relates to a device to tear open plastic bags containing grass clippings, leaves or other waste material. It is particularly adapted to attach to the load bar at the rear of a compactor truck to be powered by the truck's air system. The opener is an improvement over the waste material loading device in U.S. Pat. No. 5,253,971.

BACKGROUND OF INVENTION

Plastic bags are widely used for the collection of grass, leaves and other yard waste. They provide a convenient means to move this material to a curbside location for pickup by a compactor truck.

When the truckload is to be dumped in a landfill or location where the trash can biodegrade, it is desirable that the grass or other material be free of the plastic bags. Some haulers achieve this by having an operator use a knife at the rear of the truck to cut open each bag so that the trash falls into a receptacle chamber for delivery into the truck's compartment without the bag. The sliced-open, empty bag is then deposited in a separate container.

One object of this invention is to provide a bag-opener device for the rear of a compactor truck which will quickly, easily and positively tear open the bottom of a plastic bag whereby the trash in the bag will fall out into the receiving compartment of the truck when the torn bag is lifted by the operator.

Another object of this invention is to provide a bag opener which can be installed or removed from the rear of a compactor truck in a few minutes and does not alter the normal operation of loading the truck and the performance of the compacting operation.

Another object of this invention is to provide a pair of fingers which are projected into the bottom of a plastic bag and then moved in opposite directions to rip open a large hole in the bottom of the bag and enable the contents thereof to be easily discharged.

A further object of this invention is to provide a bag opener having an operating cycle of only a few seconds whereby loading material at the back of a truck is fast and convenient, increasing the productivity of the operators loading the truck.

A still further object of this invention is to provide a bag opener which is safe for the loader to operate, a pair of fingers being located in an at rest starting position retracted under a support housing and being actuated by the operator to project into a plastic bag and tear the bag apart.

Other objects of this invention will be apparent hereinafter from the specification and from the recital in the appended claims.

SUMMARY OF INVENTION

This invention provides a plastic bag opener device having a pair of fingers on a support bar. The fingers start from a retracted position next to each other. They are projected together into the bottom of the bag to be opened. After puncturing the bag, the fingers are moved in opposite directions away from each other to tear open the bag so that the trash in the bag is free to fall therefrom. Then the fingers are retracted and returned to their starting positions to tear open the next bag.

DESCRIPTION OF INVENTION

Figure 1:
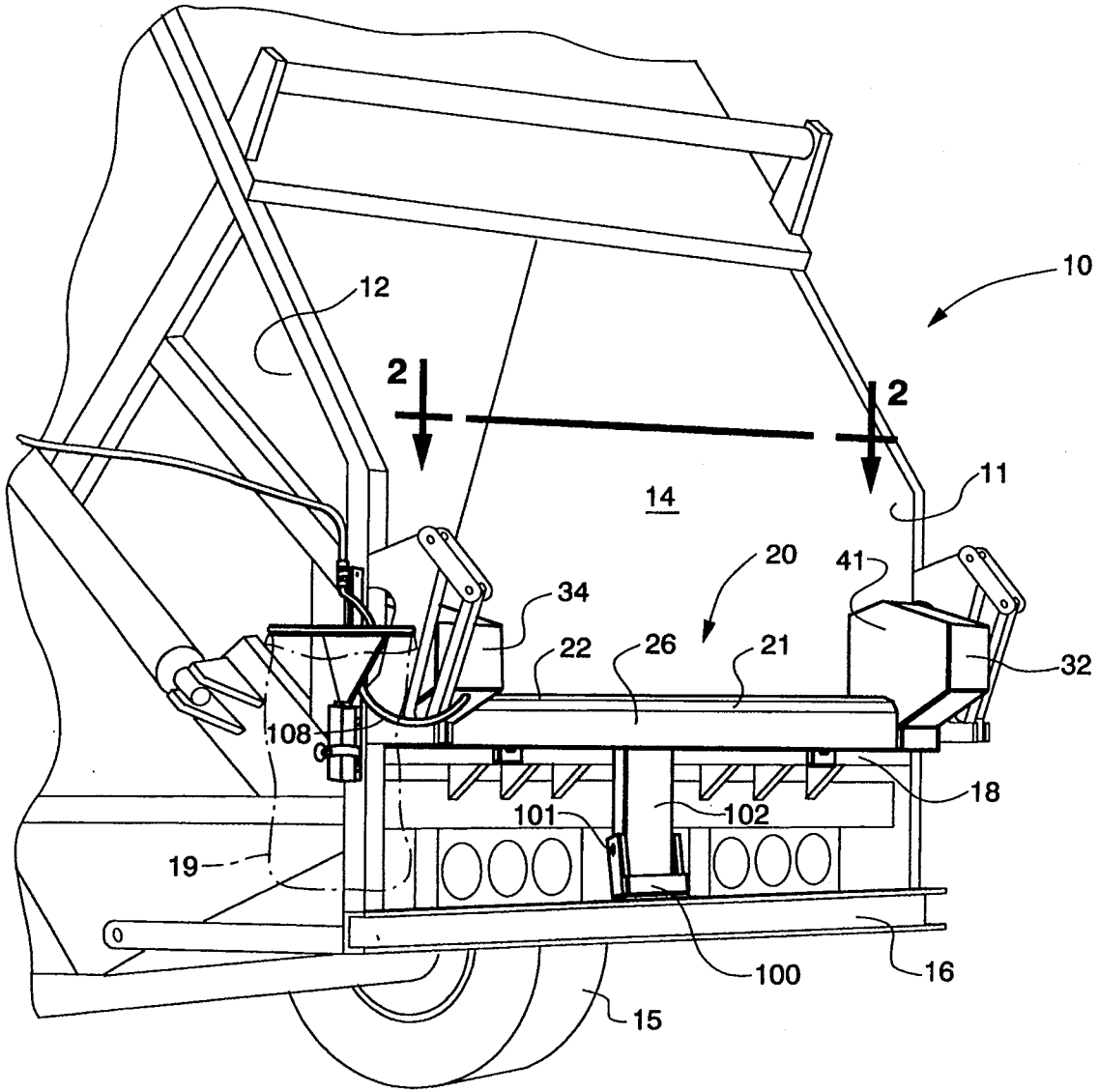
FIG. 1 is a perspective view of the rear of a compactor type trash truck having mounted thereon a bag opener constructed according to the preferred embodiment of this invention.

Referring now to the drawings by numerals of reference, 10 denotes generally the rear section of a compactor type trash truck. The truck body has vertical fore and aft sidewalls 11 and 12 on opposite sides respectively of a trash receiving compartment or area 14. One ground wheel is shown at 15.

The truck has a vertically extending transverse rectangular rear frame 16 formed with an upper horizontal loading bar 18. Bar 18 is about as high as the waist of a loader operator standing on the ground behind the truck. The operator throws boxes and other trash into compartment 14.

When the trash to be loaded into truck 10 is contained in plastic bags B at curbside, the bag opener device 20 of this invention is provided. Along one side of the rear of the truck is a sack 19, FIG. 1, adapted to receive emptied plastic bags. Opener 20 is located above bar 18. It has a transverse support housing 21 FIGS. 1–4, formed with a downwardly and forwardly inclined top wall 22, a vertical front wall 24, forming an opening 25 and a curved and downwardly extending rear wall 26 as shown in FIGS. 3 and 4. Support 21 is carried on brackets 28, connected by bolts 29 to a section 30 of truck floor 31. The truck floor slopes downwardly and forwardly at the bottom of compartment 14. At the ends of opener 20, there are vertical housings 32 and 34 connected to support housing 21 and to the side walls 11 and 12 respectively of the truck body.

Figure 4:
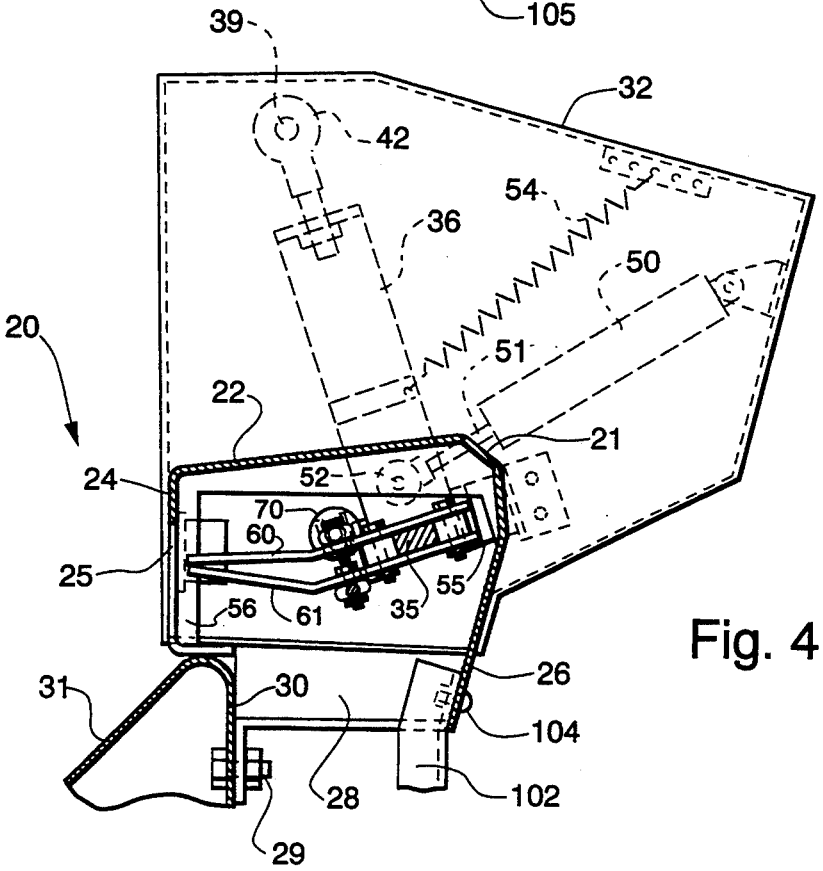
FIG. 4 is a view similar to FIG. 3 showing the fingers in retracted position under a support housing.
Figure 5:
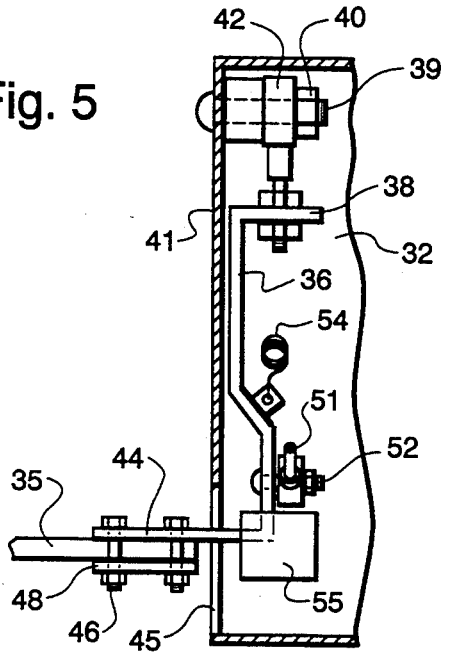
FIG. 5 is a section taken on the line 5—5 of FIG. 2 showing the S-shaped swing arm at one end of the device supporting the rail on which the fingers are carried and slide, there being a similar swing arm at the opposite end of the rail.

Bag opener 20 has a transverse guide rail 35 located inside of support 21 and extending from one side of the truck body to the other. Rail 35 is rectangular in cross section. At the end of rail 35 toward wall 11, the rail is supported by an S-shaped hanger bracket 36 as shown in FIGS. 3 and 4 and in detail in FIG. 5.

The upper end 38 of bracket 36 is connected to and hangs down from a pivot pin 39 fastened by nut 40 to the side wall 41 of housing 32. A bushing 42 forms a pivotal connection whereby bracket 36 and the rail 35 thereon can be swung from the position shown in FIG. 4 to the position in FIG. 3, and returned.

At its lower end, bracket 36 has a section 44 which projects through an opening 45 in wall 41 of housing 32. Section 44 is connected by bolts 46 and backplate 48 to one end of rail 35.

An air cylinder 50 is supported in housing 32 and provided with a piston rod 51 pivotally connected at 52 to bracket 36. When cylinder rod 41 is extended as shown in FIG. 3, bracket 36 extends vertically. When rod 41 is retracted, FIG. 4, bracket 36 extends at a downward, rearward angle relative to pivot pin 39.

A fail-safe spring 54 is connected between housing 32 and bracket 36 to hold rail 35 in a retracted position as shown in FIG. 4 if there is no force on piston 41 to extend it. A stop 55 is provided in the structure to limit the counterclockwise swinging movement bracket 36, FIG. 4. There is a second stop 56 which limits the clockwise swing of the bracket, FIG. 3.

Rail 35 is supported at end 35' opposite housing 32 at housing 34 adjacent wall 12 of the truck structure. The support arrangement at this other end is similar to that used in relation to housing 32 and described relative to FIGS. 3–5. The same reference numerals are applied to the support of rail 35 adjacent truck wall 12 and marked with prime designations.

Mounted on rail 35 for swinging movement therewith, are a pair of fingers which are normally next to each other, namely upper finger 60 and lower finger 61. In addition to swinging with rail 35 from the position shown in FIG. 4 to the position in FIG. 3 and return, the fingers are also slidable longitudinally on rail 35 during operation of opener 20.

Figure 6:
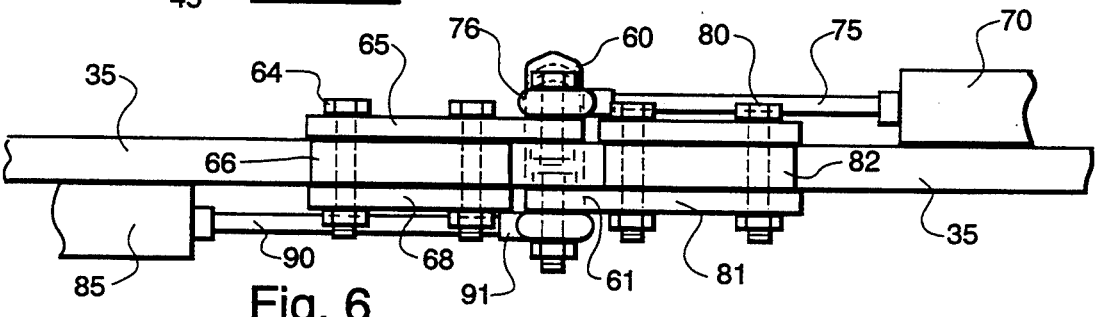
FIG. 6 is a rear view of the center area of the bag opener with the fingers in aligned positions, one over the other, and taken on the line 6—6 of FIG. 2.
Figure 10:
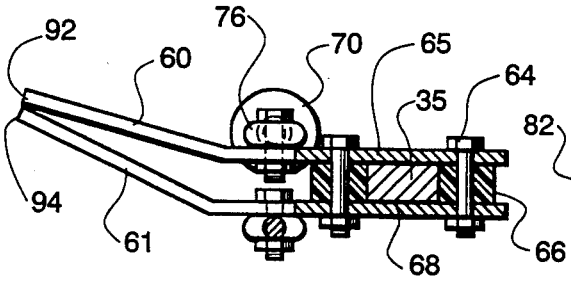
FIG. 10 is a section taken on the line 10—10 of FIG. 2 looking in the direction of the arrows and showing the top finger slidably mounted on the guide rail using plastic spacer blocks clamped between the finger and a backing plate.

Upper finger 60 is mounted on rail 35 as shown in FIGS. 6 and 10, by bolts 64 which pass through an extended section 65 of finger 60 and then through plastic spacer blocks 66 and a back plate 68. The box frame fits around rail 35 so that finger 60 has slidable engagement with the rail.

Figure 8:
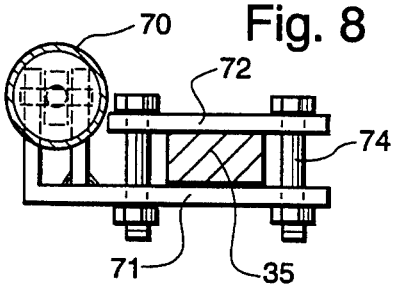
FIGS. 8 and 9 are sections taken on the lines 8—8 and 9—9 respectively, of FIG. 2, and showing how the tear cylinders are clamped on the guide rail.

Connected to upper finger 60 is an air cylinder 70 clamped on the end of rail 35 toward truck wall 11 by an F-shaped bracket 71, backing place 72 and bolts 74 as shown in FIG. 8. At its opposite end, cylinder 70 has a piston rod 75 connected at 76 to upper finger 60, FIGS. 6 and 10.

Figure 11:
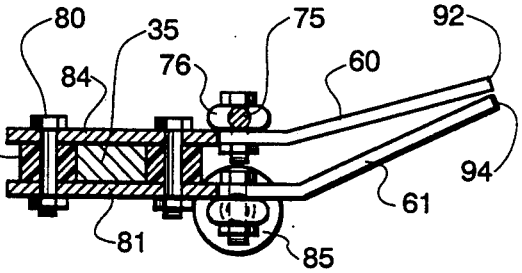
FIG. 11 is a section similar to FIG. 10 taken on the line 11—11 of FIG. 2 looking in the direction of the arrows and showing the bottom finger slidably mounted on the guide rail using a structure similar to that shown in FIG. 10.

Lower finger 61 is mounted on rail 35 as shown in FIGS. 6 and 11 by bolts 80 through extended section 81 of finger 61, plastic spacer blocks 82 and a back plate 84. The structure fits around rail 35 to provide for slidable movement of finger 61 on the rail.

Figure 9:
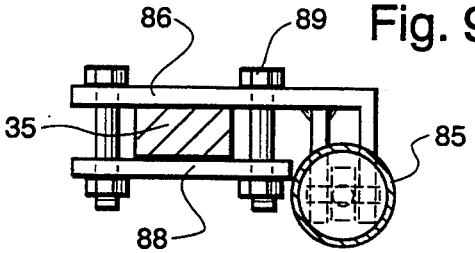

Connected to lower finger 61 is an air cylinder 85, FIGS. 9 and 11, clamped on the end 35' of the rail, opposite cylinder 70 and toward truck wall 12. There is an F-shaped bracket 86, backing plate 88 and bolts 89. Cylinder 85 at its end opposite the mounting, has a piston rod 90 connected at 91 to lower finger 61.

Figure 7:
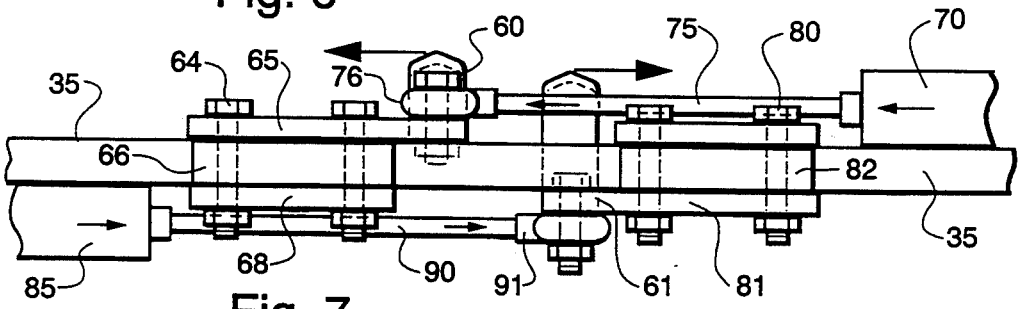
FIG. 7 is a view similar to FIG. 6 with the fingers starting to separate responsive to actuation of the air cylinders, the top finger moving toward the left and the bottom finger toward the right on the rail which supports the fingers.

As shown in FIG. 7, compared to FIG. 6, cylinder 70 is adapted to move upper finger 60 in one direction toward truck wall 12 and cylinder 85 moves lower finger 61 in the opposite direction toward truck wall 11. The direction of movement is shown by the arrows in FIG. 7.

Fingers 60 and 61 each have a V-shaped point, 92 and 94 respectively which faces towards the front of the truck. Each point is blunt, not sharp, so engagement with a person's hand will not result in a cut. However, the fingers will easily thrust through the bottom of a plastic bag.

Figure 2:
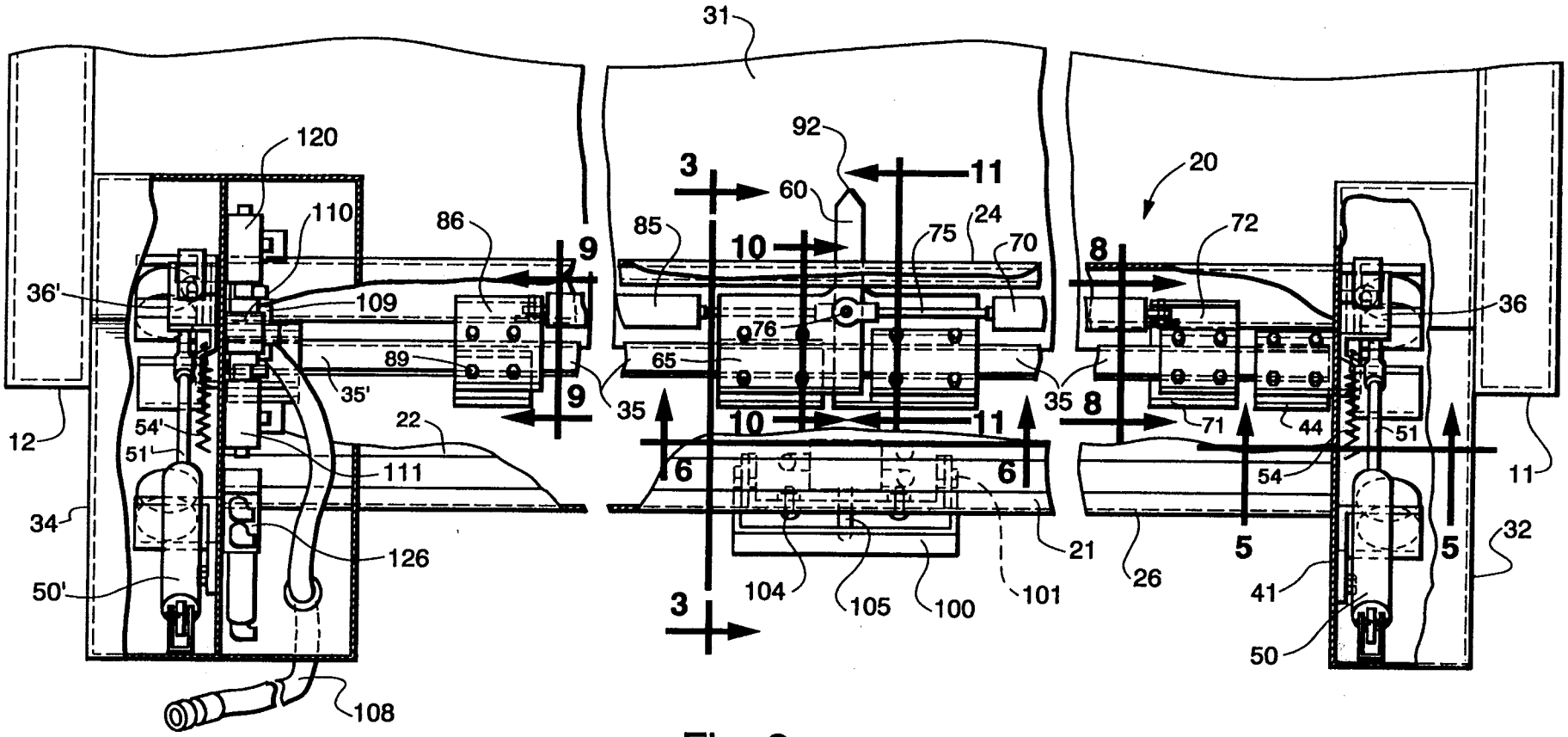
FIG. 2 is a top view of the opener in place on a truck taken on the line 2—2 of FIG. 1 and with the sheet metal of a housing support broken away to better show the components of the bag opener.
Figure 3:
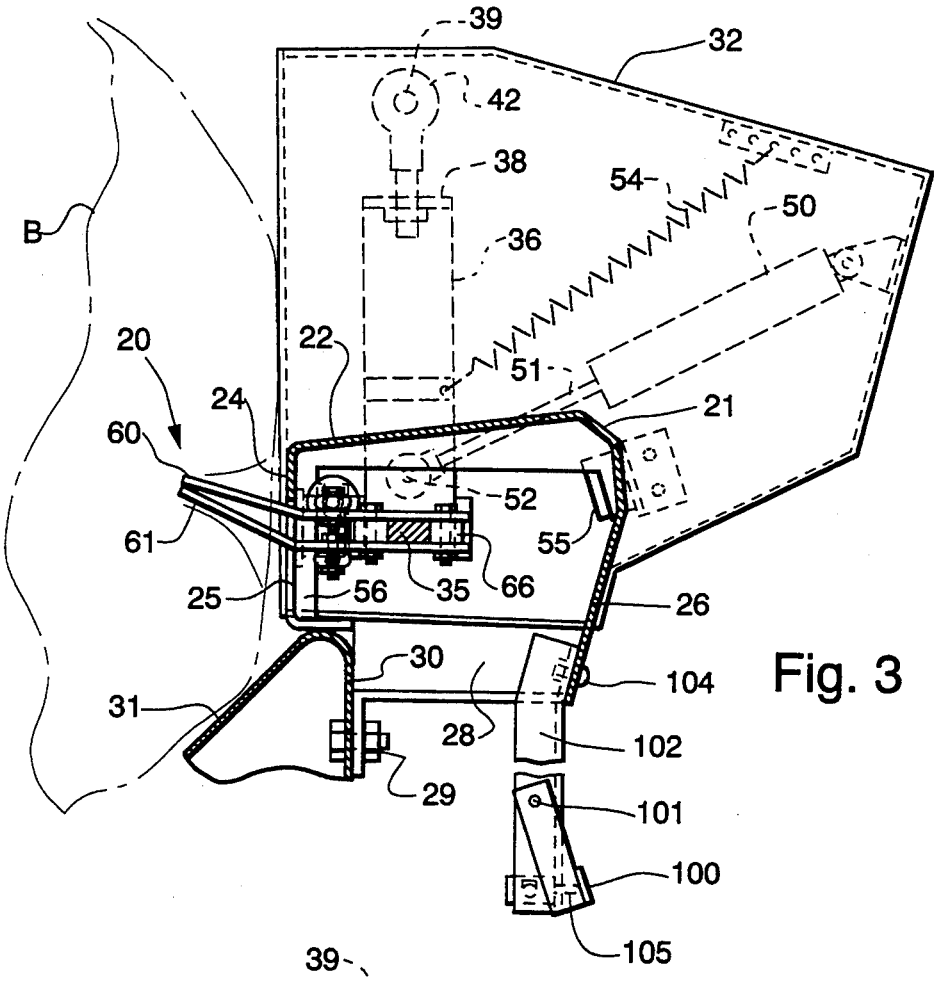
FIG. 3 is a sectional view taken on the line 3—3 of FIG. 2 looking in the direction of the arrows showing the pair of bag-piercing fingers in a projected position, puncturing the bottom of a plastic bag, shown in dotted lines.

To initiate the operation of bag opener 20, a trip 100 is provided at the center rear of the truck, knee-high from the ground, FIGS. 1–3. Trip 100 is pivotly mounted at 101 on a brace 102 which depends from support housing 21 and is connected to rear wall 26 at 104, FIG. 3. Trip 100 engages a spring biased plunger 105 of a primary control valve 106, FIG. 12. When the person loading the truck pushes trip 100 using a knee, it depresses plunger 105. The compressed air system is activated by valve 106 to cause the opener 20 to cycle.

Figure 12:
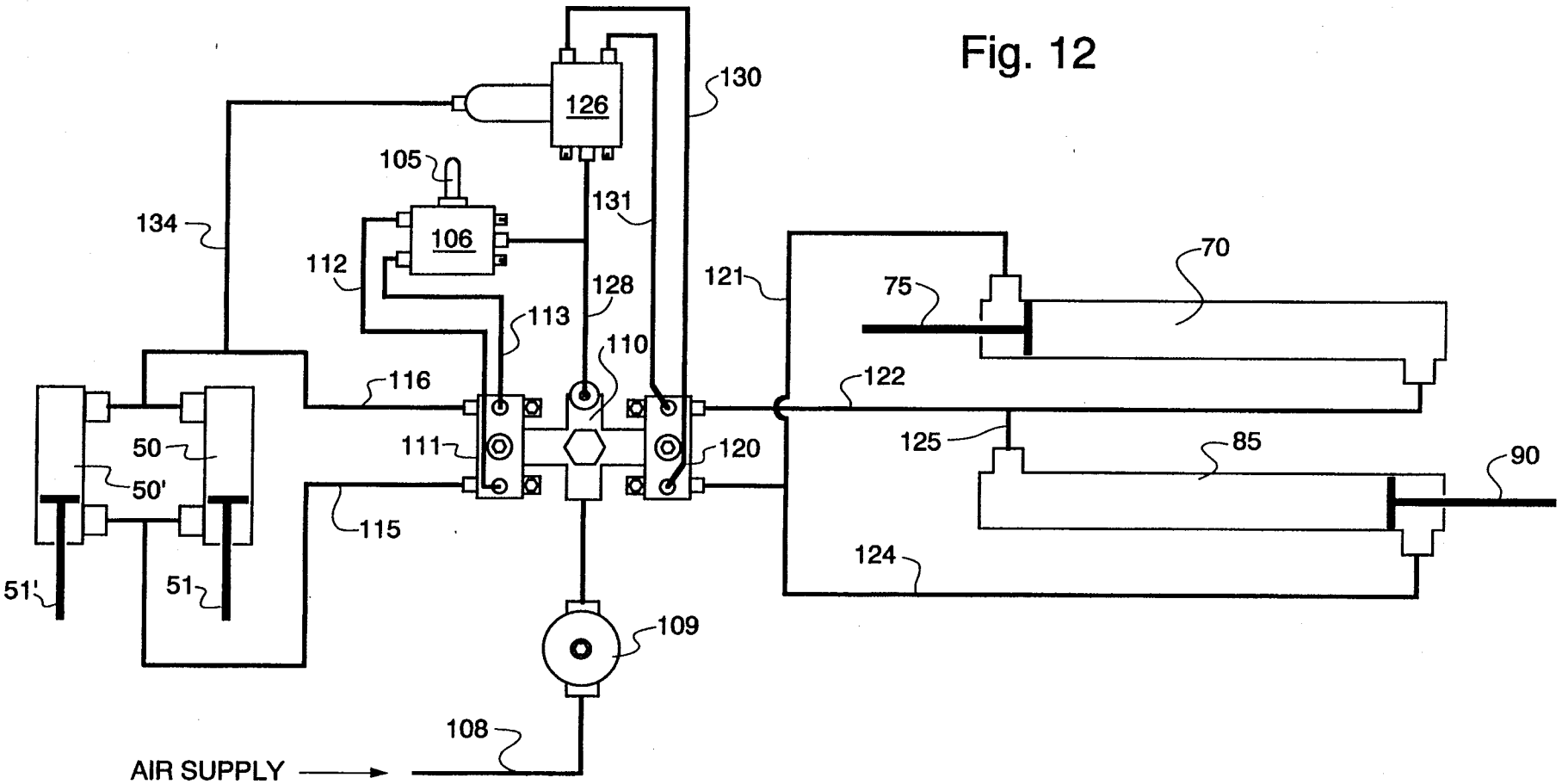
FIG. 12 is a schematic of the air system employed in the bag opener system.

Referring to the schematic shown in FIG. 12, compressed air is supplied by the air system on the truck. An air take-off hose 108, FIG. 2, connects to the truck air line and to air pressure regulator 109. A compacted truck usually operates its air brakes, axle suspensions and other auxiliary systems at about one hundred thirty-five to one hundred fifty pounds pressure. The bag opener system is operated at around one hundred ten pounds pressure produced by regulator 109.

The air pressure is routed from regulator 109 to a manifold 110 in the form of a steel cross. Manifold 110 directs air to servo valve 111 and through lines 112 and 113 to primary control valve 106 controlled by plunger 105 activated by knee trip 100. Valve 106 operates through lines 112 and 113 to valve 111 to operate swing cylinders 50 for rail 35 through lines 115 and 116.

Manifold 110 also directs air to servo valve 120 which through lines 121–122 operates tear cylinder 70 for reciprocating finger 60 on rail 35 and through lines 124–125 to operate tear cylinder 85 to reciprocate finger 61 on the rail. Air is also provided for a back pressure sensitive secondary valve 126 from line 128 to the manifold and lines 130–131 to servo valve 120, and line 134 to the swing cylinders.

OPERATION

Bag opener 20 operates sequentially as shown in FIGS. 13A through 13E. To use the device, the operator loading the truck picks up a plastic bag B at curbside and places the bag in a bag receiving location in the center area of support 21 so that the bag overlaps support side wall 24, FIGS. 3, 13A and 13B. At this stage, fingers 60 and 61 are aligned, one over the other, in the center of rail 35 and retracted to the position shown in FIG. 4. Holding the tied end of bag B, trip 100 is depressed by the loader's knee to move plunger 105 to activate control valve 106.

Air is supplied to cylinders 50-50' and rail 35 is swung on an arc from the position shown in FIG. 4 until stop 56 is engaged and the rail is positioned as shown in FIG. 3. Upper finger 60 and lower finger 61 move in unison and are projected through opening 25 in wall 24 of support 21. Moving on an arc, and with the upward slant of the fingers as shown in FIG. 3 and 4, the points 92 and 94 of the fingers are thrust into the overhanging plastic bag B. The fingers puncture the bottom of the bag. With the fingers next to each other a single hole is made in the bag through which both fingers project.

When bar 35 engages stop 56 the pivoting of the bar ceases. This causes a build up or spike of air pressure in pressure sensitive valve 126. Valve 126 operates to direct air to servo 120. Cylinders 70 and 85 are activated and through piston rods 75 and 90 slide the fingers 60 and 61 on bar 35 away from each other, FIGS. 6, 7 and 13C. The fingers move apart a distance of about a yard and provide a positive vigorous tearing action on the bottom of bag B.

Figure 13A:
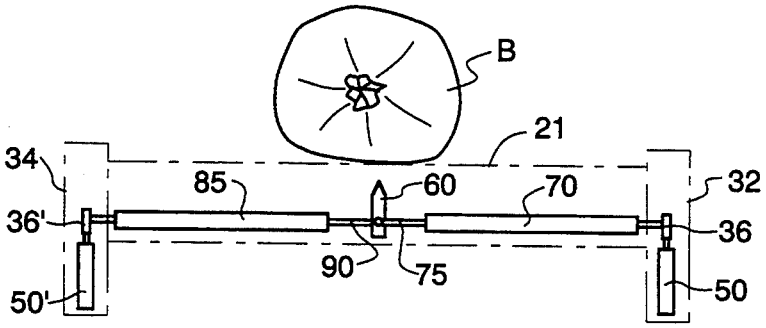
FIGS. 13A through 13E are diagrammatic views showing the operation of the bag opener as it travels through a complete cycle.
Figure 13B:
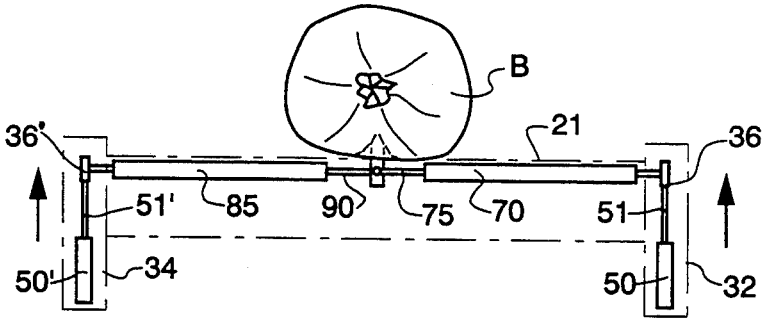
Figure 13C:
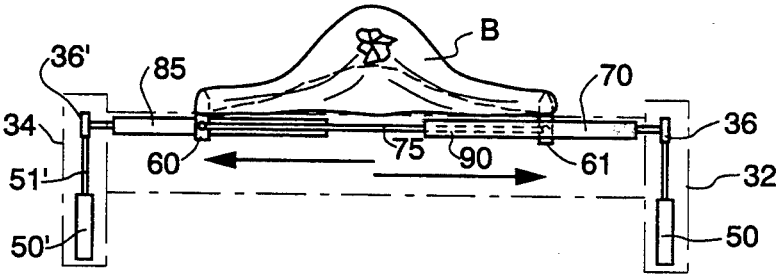
Figure 13D:
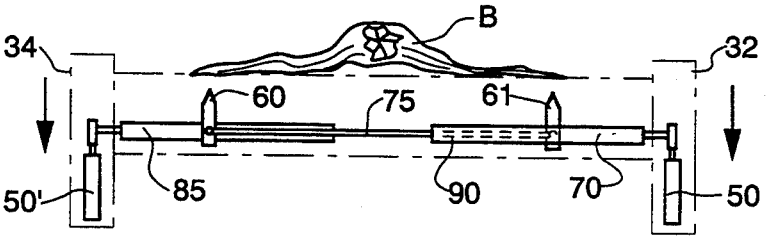
Figure 13E:
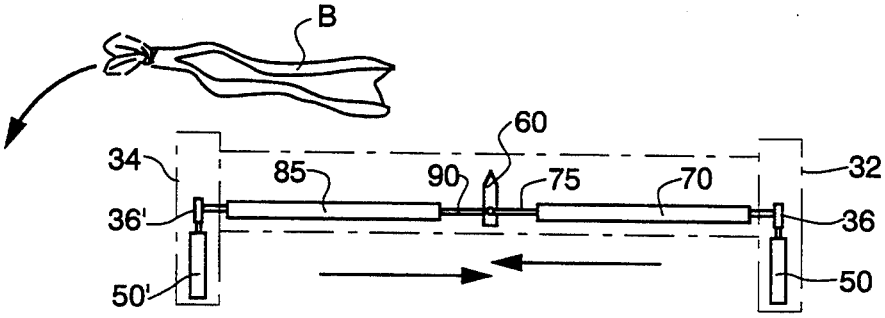

When the person operating opener 20 releases trip 100 after a bag has been ripped open, rods 51-51' of cylinders 50-50' are withdrawn from the position shown in FIG. 3 and 13C to a retracted location as shown in FIG. 4 and FIG. 13D. The springs 54-54' insure that rail 35 is retracted back under support 21 before the fingers return to their starting positions. After bar 35 has retracted fingers 60–61, then cylinders 70 and 85 return the fingers to their central home locations, FIG. 13E.

After the bag has been ripped open at its bottom, the operator lifts the torn bag from support 21. The grass, leaves or other trash falls through the large hole in the bottom of bag B and into compartment 14 of truck 10. The emptied bag is then deposited by the operator into receptacle 19 at one side of the truck rear.

The operating cycle of the bag opener device 20 is rapid. The sequence described takes about three seconds. Much less time is required to open a bag with device 20 than is required when the operator manually cuts open each bag with a knife.

The primary knee trip valve 106 and back pressure valve 126 are provided with cushion adjustments so that the operation of the device works in proper sequence. With the system described, the movement of fingers 60 and 61 away from each other does not start until they have been thrust deeply into a bag on support 20. This insures an aggressive and complete tearing action when the bottom of the bag is torn apart.

Valve 126 has cushion adjustments whereby the preload pressure is such that cylinders 70 and 85 are not activated until the swinging of arm 35 engages the stop 56 which limits the projected movement of hangers 36-36' and back pressure builds up.

Further, by moving the fingers 60 and 61 apart a substantial distance a large hole is ripped in the bag. The two fingers working together and moving in opposite directions provides a positive tearing action.

The operator holds knee trip 100 in a pivoted position during the bag opening cycle. If the person's knee is removed from the trip the unit stops immediately and the fingers return to their central home position.

Although the bag opener device of this invention has been described for mounting on the rear of a trash truck, it could also be used in other operations and places such as a compost facility where bags of grass and other yard waste are delivered by truckloads to an area where yard waste is to be dumped. When not mounted on a truck, a separate source of air pressure would be required to power the device. While the invention has been described in connection with a particular embodiment thereof, it is subject to modifications to achieve the stated objectives and as recited in the appended claims.

Having thus described my invention what I claim is:

1. A bag opener for tearing a hole in a trash bag of plastic or other material filled with grass, leaves or other trash and depositing the material in a compartment on a trash truck, comprising:

a support;

means mounting said support on the truck to receive a bag placed thereon;

rail;

means mounting said rail for swinging movement in one direction relative to said support;

a pair of fingers adjacent each other and carried on said rail for swinging movement therewith in a path from a retracted position spaced from said bag to a projected position wherein said fingers puncture the bag; and means supporting said fingers on said rail for slidable movement on the rail away from each other and transverse to said one direction to positively tear open the bag after puncturing.

2. A bag opener as recited in claim 1 wherein said support extends horizontally and transversely relative to a rearward end of the truck and above said compartment, said rail extending parallel and beneath said support; the bag being disposed on and overhanging said support in said path of movement of said pair of fingers; and said mounting means for said rail comprising a pair of hanger brackets, one for each end of the rail.

3. A bag opener as recited in claim 2 wherein swing cylinder means is provided to swing said rail and the fingers thereon from said retracted position to said projected position and return;

and tear cylinder means is provided to slide said fingers on said rail and away from each other to tear open a bag.

4. A bag opener as recited in claim 3 wherein said support is mounted on the truck spaced from the ground so that a loader operator can easily place a bag on the support.

5. A bag opener as recited in claim 1 wherein said pair of fingers are carried on said rail one over the other and adjacent to each other whereby when the fingers are projected into a bag on said support they puncture the bag simultaneously and produce generally a single hole, the fingers exerting a positive tearing action on the bag when moved in opposite directions after projection into the bag.

6. A bag opener as recited in claim 3 wherein said swing cylinder means and tear cylinder means are operated pneumatically, the air being supplied by an air system on the truck.

7. A bag opener as recited in claim 6 wherein there is a compressed air system controlled by a knee pad and moveable to activate the bag opener.

8. A bag opener as recited in claim 1 wherein said rail swings on an arc relative to said support and a pair of stops are provided to limit the movement of the rail to said retracted position and the other stop to limit movement of the rail to said projected position.

9. A bag opener as recited in claim 7 wherein a pressure sensitive valve is provided in the air system whereby the fingers do not slide on said rail until the fingers have been projected to puncture said bag.

10. A bag opener as recited in claim 1 wherein said truck compartment has a downward sloping floor, said support being positioned adjacent an upper end of said floor whereby when a bag is torn open the material in the bag is dislodged onto the compartment floor.

11. A bag opener for tearing a hole in a trash bag of plastic or other material comprising:

a support on which a bag is placed;

a pair of elongated fingers mounted on a rail in a co-extensive position adjacent each other and spaced from said bag; and means for moving said rail in one direction toward said bag to project said fingers to puncture a hole in the bag and then after a puncturing has occurred sliding the fingers away from each other on the rail and transverse to said one direction to provide a positive tearing action on the bag.

12. A bag opener as recited in claim 11 wherein said moving means comprises swing cylinder means which moves said rail in said one direction to project the pair of fingers into said bag and tear cylinder means which moves said fingers away from each other on said rail after a bag has been punctured.

* * * * *